United States Patent [19]

Mancini

[11] Patent Number: 4,819,413

[45] Date of Patent: Apr. 11, 1989

[54] PRECISION LID FIT FILLING MACHINE

[75] Inventor: Derek V. Mancini, Markham, Canada

[73] Assignee: Consumers Glass Company Limited, Etobicoke, Canada

[21] Appl. No.: 345,008

[22] Filed: Feb. 2, 1982

Related U.S. Application Data

[63] Continuation of Ser. No. 114,943, Jan. 23, 1980, abandoned.

[51] Int. Cl.[4] ..... B65B 7/28

[52] U.S. Cl. ..... 53/478; 53/282; 53/329; 53/367

[58] Field of Search ..... 53/478, 476, 477, 487, 53/296, 300, 282, 329, 373, 298, 488, 367

[56] References Cited

U.S. PATENT DOCUMENTS

| | | | |
|---|---|---|---|
| 3,210,910 | 10/1965 | Seefluth | 53/478 X |
| 3,527,020 | 9/1970 | Mancini | 53/300 X |
| 3,714,755 | 2/1973 | Phalin et al. | 53/300 X |
| 3,783,581 | 1/1974 | Pierce | 53/282 X |
| 4,077,180 | 3/1978 | Agent et al. | 53/282 X |
| 4,176,507 | 12/1979 | Mancini | 53/282 X |

*Primary Examiner*—Horace M. Culver
*Attorney, Agent, or Firm*—Sim & McBurney

[57] ABSTRACT

The specification discloses a method and apparatus for accurately positioning a lid of a series of lids above a container flange in preparation for the heat sealing operation. The apparatus is designed to maintain the production rate of prior art filling and packaging machines while still precisely locating a lid such that little or no overhang of the lid relative to the flange of a container occurs. This is achieved by providing a start and stop type conveyor with individual conveyor plates provided with alignment lugs for urging the flange of a container and a lid into alignment. The resulting product is less vulnerable to lid damage and hence is more presentable when served to the consumer. This system is particular valuable in the packaging of individual creamer containers.

9 Claims, 7 Drawing Sheets

PRECISION LID FIT FILLING MACHINE

This is a continuation of application Ser. No. 114,943, filed Jan. 23, 1980, and now abandoned.

FIELD OF THE INVENTION

This invention relates to a method for precisely locating and aligning a flange of a container and a precut lid of a series of interconnected lids, such that after the heat sealing operation, the body portion of the lid does not overhang the flange of the container.

BACKGROUND OF THE INVENTION

In recent years, the popularity of individually portioned containers for food products and particularly, dairy products, has rapidly increased and the need to package these products in a suitable manner such that they be served to customer, has been realized by the industry. However, to make these products economically viable, production rates must be fairly high. To achieve these production rates the prior art packaging machines have been designed such that the precise location of the container and a lid is not necessary and tolerance variations in both the lid and container do not appreciably affect the seal. One of the most popular methods of avoiding problems caused by tolerance variations is to provide an oversized lid such that the precise location of the lid relative to the flange is not necessary and the lid only need be generally located above a flanged container for a proper heat seal to result. However, damage to the portion of the lid overhanging the flange of the container can result, seriously detracting from the appearance of the product.

Machines, which generally fall into this category, are disclosed in U.S. Pat. Nos. 3,527,020, Mancini; 3,714,755, Phalin et al; 3,783,581, Pierce; 4,077,190, Agent et al and 4,176,507, Mancini.

My earlier U.S. Pat. No. 4,176,507 discloses an improved structure for controlling a lid of a series of interconnected lids during the heat sealing and provides increased control as the lid is still connected to the series of interconnected lids, until the heat seal operation has been commenced. During the heat sealing operation, the lid is cut from the series of interconnected lids thereby freeing the lids to realign within the conveyor in preparation for sealing the following container. In this way accumulative errors in the location of the series of interconnected lids are avoided as realignment occurs after each heat sealing operation. Thus improved alignment of the lids in the conveyor is achieved, however, the exact position of the container in the conveyor varies. To assure a good heat seal is provided oversized lids still are used.

One such method which uses an oversized lid and provides one possible solution to the overhang problem, is shown in U.S. Pat. No. 3,838,550 which issued to Mueller, Oct. 1, 1974. An oversized heat sealable lid is applied to each container and the resulting overhanging lid is pressed down along the sides of the container. With this method the precise location of a precut lid relative to a container is not required, however, the resulting product even with the overhanging lid portion pressed downward has the appearance of poor workmanship. This problem is further compounded by damage during shipment where the overhanging portion of the lid becomes tattered.

Although these methods ensure a good heat seal between the lid and the container, the resulting product has the appearance of being produced by a cheap process and if the overhanging portion of the lid becomes crimped or torn it leads to the appearance of shoddy workmanship and the suggestion that the product has been tampered with. Therefore, it is desirable to produce a product where the precut lid is of sufficient area to cover the container and align the lid for heat sealing, such that the lid does not overhang the flange after it has been sealed in place. The only exception to this being the tab portion of the lid which projects outwardly from the flange, such that the lid may be removed.

In some applications, a continuous sheet has been applied over nested containers and a dye cutting operation is used to cut out the sealed lid from the sheet material and in some circumstances this cutting operation also dye cuts the container flange. Although this system provides a lid which is precisely located above a container flange the economy and convenience of precut and preprinted lids is not realized.

The present invention overcomes the disadvantages of the prior art machines and process.

SUMMARY OF THE INVENTION

In a process, according to an aspect of the invention, for sealing a container with first lid of a series of like lids interconnected by severable tabs, each lid has a body portion of essentially the same size as the container flange peripheral edge and a tab projecting from the body for removing a lid. The steps of the process comprise in sequence:

(a) dispensing a container into a conveyor provided with an upwardly opening guide means for first loosely receiving the flange edge of a container and subsequently by the guide means contacting the flange edge precisely locating the flange edge in the conveyor;

(b) positioning the lid loosely within the guide means of the conveyor;

(c) urging the lid downwardly within the guide means, and (d) cutting the lid from the series of interconnected lids thereby allowing the lid to be precisely located at the base of the guide means above the flange of a container by virtue of the peripheral edge of the lid contacting the guide means whereby the flange edge and the lid edge are essentially aligned, the lid remaining in position above the container flange in preparation for sealing due to the continuing contact of the guide means with the lid edge.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
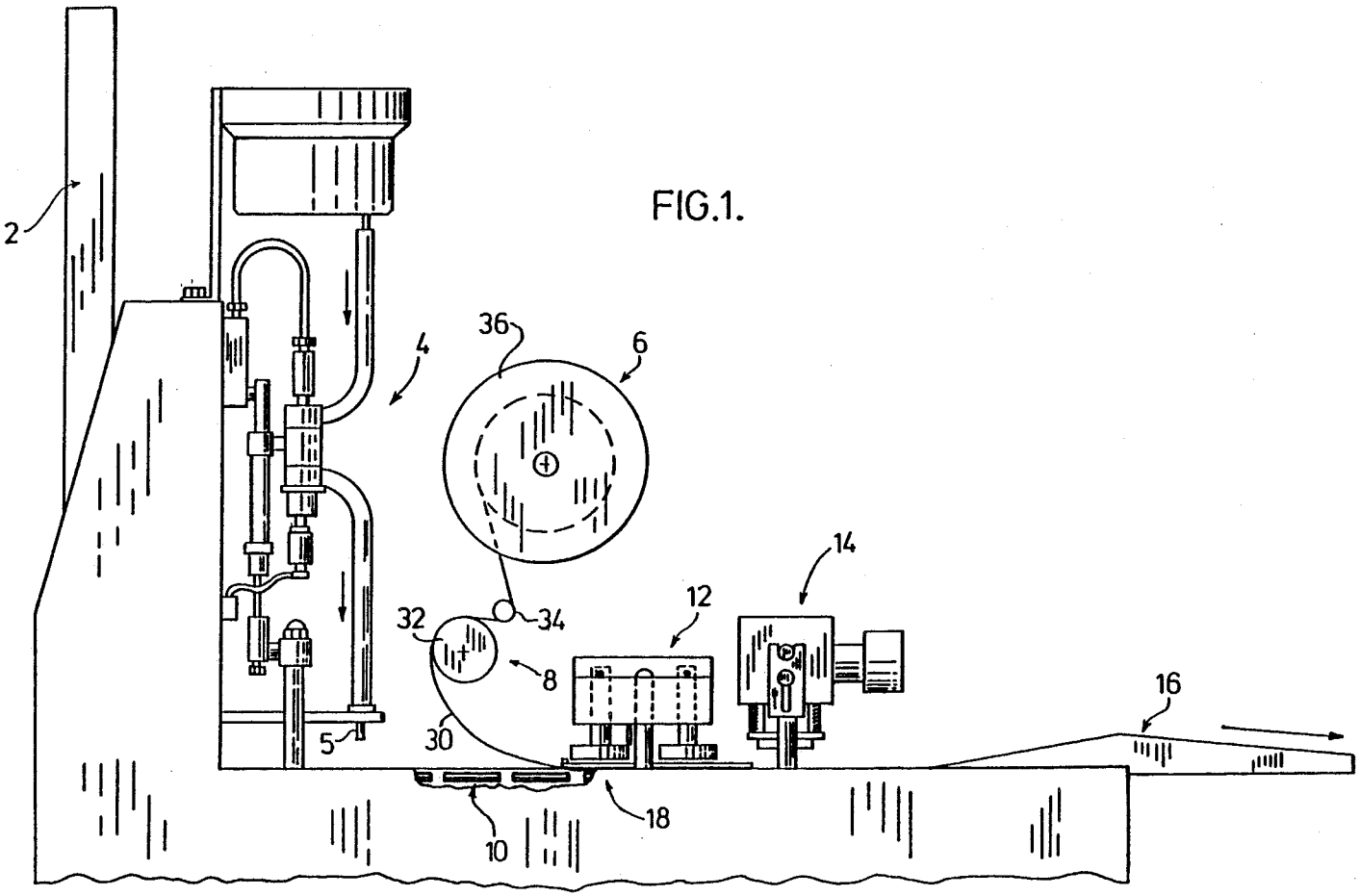
FIG. 1 is a side elevation of the container filling and sealing apparatus.

The apparatus shown in FIG. 1 is designed to fill individual portion creamer containers which have gained wide acceptance throughout both the European and the North American markets. The apparatus has a container supply chute 2, which receives a stack of nested containers and drops the containers at the appropriate time such that a container is received within the conveyor bed 10. The product filling station is generally shown as 4 and is synchronized with the movement of the conveyor bed to fill a container located beneath the spout 5. The lid supply system 6 is adapted to receive a roll of interconnected preprinted and precut container lids with a series of lids being fed past the roller 34 and onto the lid drive drum 32. The drum 32 is constantly driven, in contrast to the intermittent movement of the conveyor bed, such that the series of lids has a curved downward portion 30 which provides some compensation as the series of lids engage alignment means provided in the conveyor bed. The series of lids are generally advanced by the drive drum 32 and the conveyor bed is provided with alignment means for positioning the series of lids directly above containers. Thus the roller 34 and the drive drum 32 form the lid drive mechanism 8.

Both the lid severance station 12 and the heat seal station 14 are driven in timed relationship with the conveyor bed movement and will be more fully described in relation to the remaining figures.

To assist in positively locating the series of interconnecting lids, proximate the upper surface of the conveyor bed, guide member 18 is provided. A container unloading system is generally shown as position 16 in FIG. 1.

Figure 2:
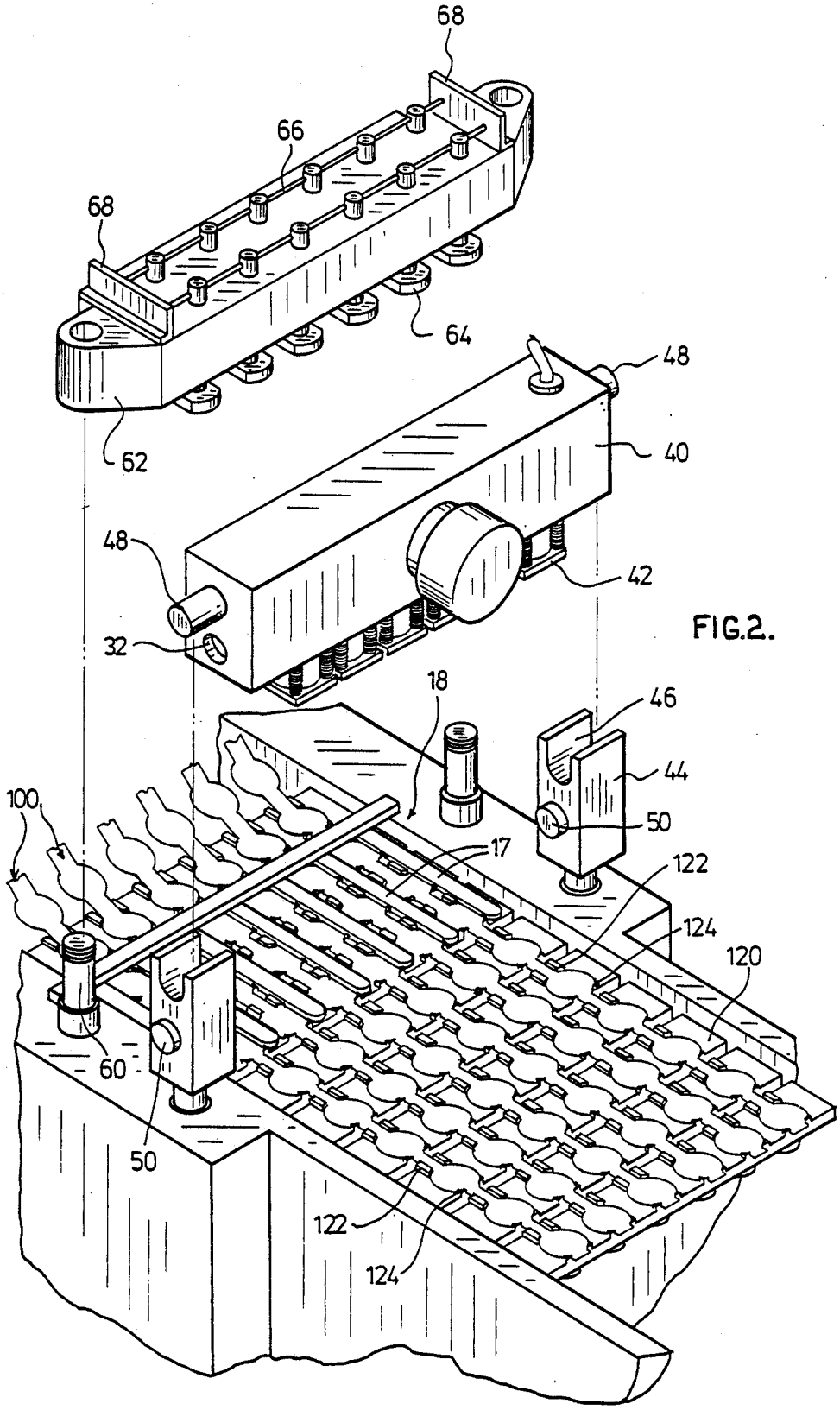
FIG. 2 is a partial perspective view of the apparatus showing the conveyor bed and heat sealing station with the clamping pads and heat sealing head partially removed for better observation.

The clamping pads support block 62 is shown in FIG. 2 with individual clamping pads 64 journalled within the support block and having a positioning rod 66 adapted to maintain the orientation of the clamping pads. These clamping pads are spring loaded and adapted to move relative to the support block when the drive means 60 lowers the support block relative to the conveyor bed, firmly positioning two adjacent lids and allowing the severance of the interconnecting tab between the lids. The clamping pads are designed to engage only a portion of a lid as the guide rails 17 extend beneath the lid severance station and contact a portion of the lid urging it downwardly into engagement with the lugs 122 and 124 which position and advance the series of interconnected lids with the conveyor movement. Due to the particular arrangement of having the guide rail 17 extend beneath the lid severance station, the clamping pads 64 must maintain their orientation relative to the conveyor bed and thus the rod 66 positively maintains this position and the brackets 68 assures the rod does not accidently disengage the clamping pads. During compression of the clamping pads, the rod merely moves upwardly with the clamping pads and the brackets 68 are of sufficient height such that the rod does not rise above the brackets.

The heat sealing unit 40 has a number of individual heat sealing pads 42 spring loaded to the base of the heat sealing unit and the drive mechanism 44 secures the heat sealing unit and synchronizes it with the movement conveyor bed. The heat sealing unit is secured to the drive 44 by the yoke and axle arrangement 46 and 48 in combination with the lock pins 50 and apertures 52.

Figure 3:
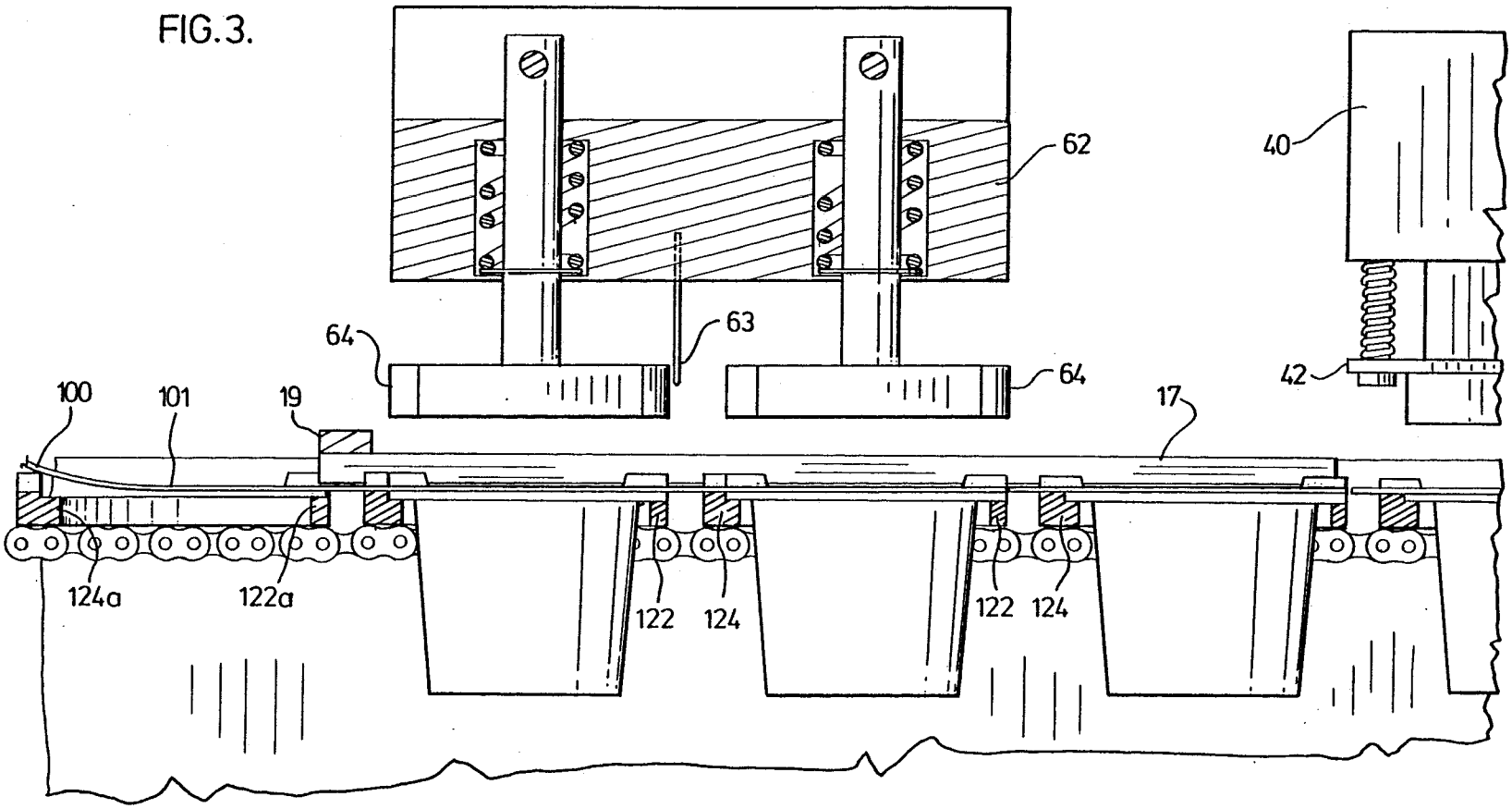
FIG. 3 is a side elevation of the conveyor bed and clamping station.
Figure 4:
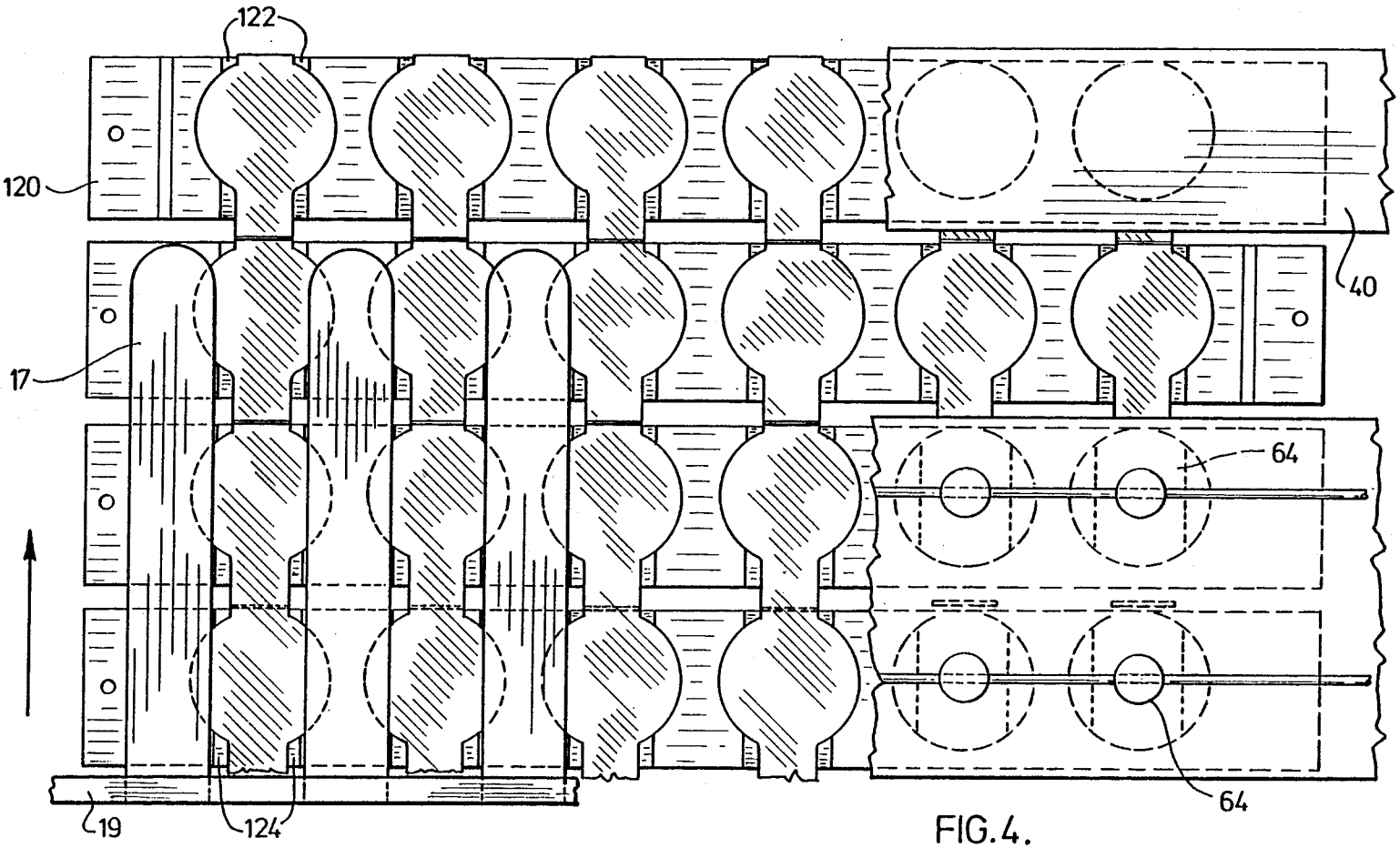
FIG. 4 is a top view of the heat sealing station.

Turning to FIGS. 3 and 4, the lid severance and heat sealing station are shown in more full detail. The series of interconnected lids 100 curve downwardly towards the conveyor bed immediately upstream of the clamping station such that only approximately 3 lids of the series engage the conveyor bed prior to severance of a lid from this series. The lid 101 immediately upstream of the severance station as shown in FIG. 3, is engaging the forward alignment lug 122*a* of that particular conveyor plate but due to the series of lids curving upward toward drive drum 32 the trailing periphery of the lid has not yet engaged alignment lug 124*a*. Thus, as shown in FIG. 3, only two lids within conveyor plates and the third lid, has not fully engaged a conveyor plate. This aspect of controlling the number of lids engaging the conveyor is important because tolerance variations in the exact spacing between lids of the series of interconnecting lids will vary within manufacturing tolerances and the cumulative variation of these tolerances increases with the number of conveyor plates engaged.

The conveyor apparatus as shown in FIG. 3 is positioned such that the conveyor bed is now stationary and the clamping pads 64 and heat sealing head 40 will move downwardly to free a lid from the series of interconnected lids and heat seal a lid to a container. After sufficient movement of the clamping pads 64 the knife 63 contacts the interconnecting tab portion of a lid and severs it freeing a lid from a series of interconnected lids. The guide rails 17 assure the series of interconnected lids remain in engagement with a portion of the conveyor bed and also assure the freed lid remains in proper location with the alignment lugs in preparation for the heat sealing operation. These guide rails 17 are supported by bar member 19 which traverses across the width of the conveyor and, is secured to the supporting sidewalls of the machine.

Figure 5:
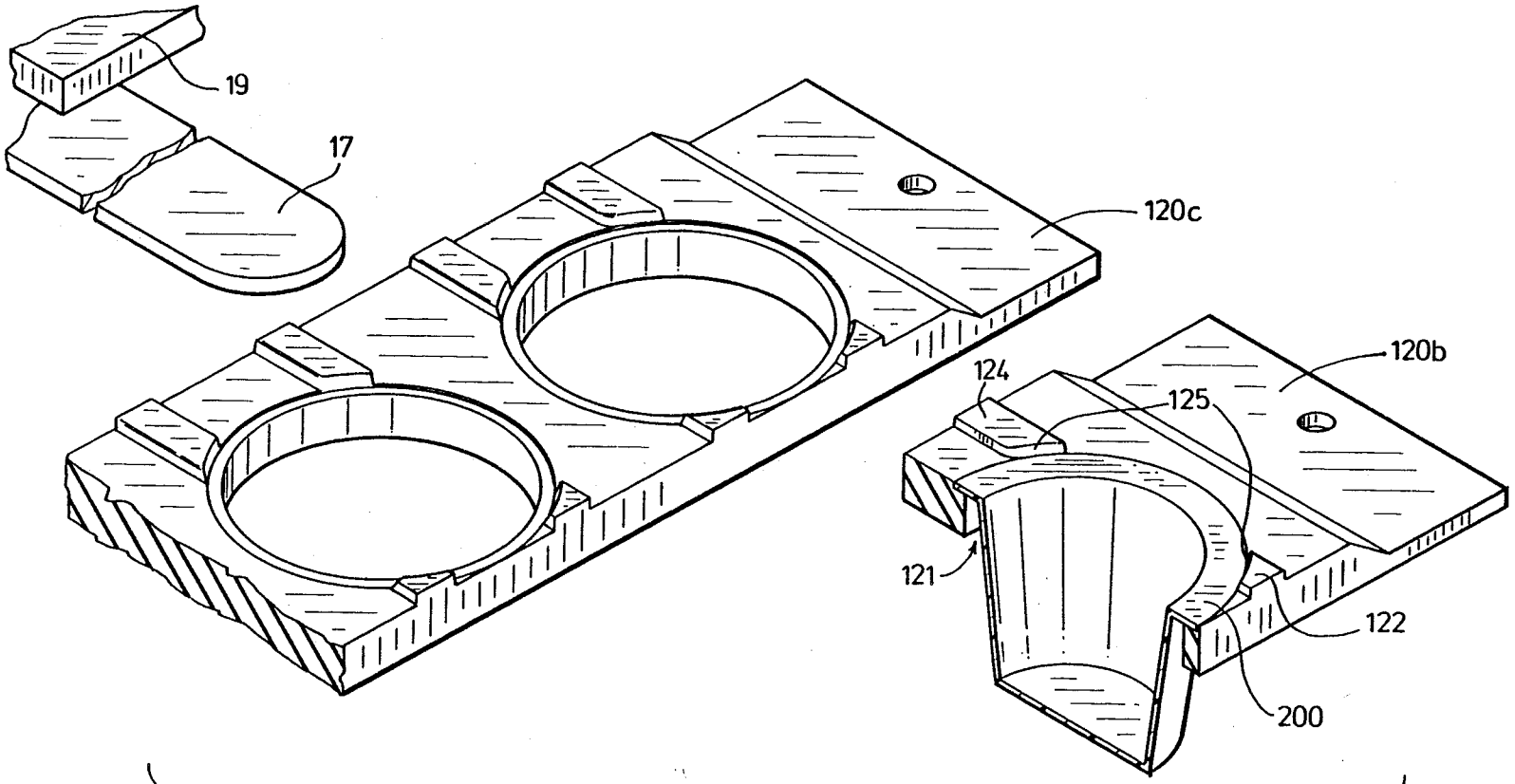
FIG. 5 is a partial view of two conveyor plates and associated guide rail.

Several plates of the conveyor bed are shown in FIG. 5 in relation to the guide rails 17. The conveyor plate 120*b* has been cut away through a nested container, showing the relationship between the alignment lugs 122 and 124, flange 200 of a nested container and aperture 121 provided in the conveyor plate. Each of the alignment lugs has been provided with a curved portion 125 corresponding to a portion of the outer periphery of the flange 200. At the upper surface of the conveyor plate, the curved portion 125 is adapted to essentially contact the outer periphery of the flange 200 with both sets of alignment lugs 122 and 124. The curved portion 125 tapers upward and outwardly from the upper surface of the conveyor plate to provide a guide means for initially, loosely receiving the container flange 200 and subsequently aligning this flange in relationship to the conveyor plate which has been recessed to receive the flange. As can be seen, the aperture 121 provided in the plate is oversized relative to the body of the nested container such that the exact position of the container in the conveyor bed is determined by the inter engagement of the container flange and the alignment lugs.

During the thermo-forming process of these containers, wide tolerance variations are expected between the center axis of the container and the center axis of the container flange. Although these axis should be the same, variations do occur however, the outer periphery of the flange is relatively constant and only varies within much smaller tolerances as it is dye cut. For example, tolerance variations in the size of lids and the diameter of creamer containers may be up to approximately four thousandths and three thousandths of an inch respectively whereas variations in the position of the center axis of the container may be as much as 20 thousandths of an inch. Thus, by aligning the container by contacting the flange and having these same alignment lugs positon the series of interconnected lids; accurate positioning of the lid, relative to the container flange can be achieved and the wide tolerance variation of the position of the center axis of the container, do not effect the sealing operation of the apparatus. Therefore, the need for oversized lids or more strict control over existing manufacturing tolerances of both lids and containers is not required with the present apparatus while still allowing precise location of the lid relative to the container flange such that the body portion 102 of the lid is directly above the container flange and only the tab portion 104 projects beyond the container flange.

The guide rail 17 shown in FIG. 5 extends between alignment lugs of adjacent container apertures 121c and is of sufficient width to contact a portion of both adjacent lids. Although this rail is in close proximity to the conveyor bed, it is not in contact with the bed and actually allows the series of interconnected lids to move along a portion of the tapered surface 125, but not above the alignment lugs thus, providing some compensation for tolerances. During the clamping operation and the heat sealing operation, a lid in contact with the alignment lug is forced downwardly and the tapered section contacts the periphery of the lid and positions it relative to the container flange. Therefore, the precise location of the lid is assisted due to the clamping action of the clamping pad 64 and during the downward movement of the heat sealing head 40, prior to bottoming out against the conveyor bed.

Figure 6:
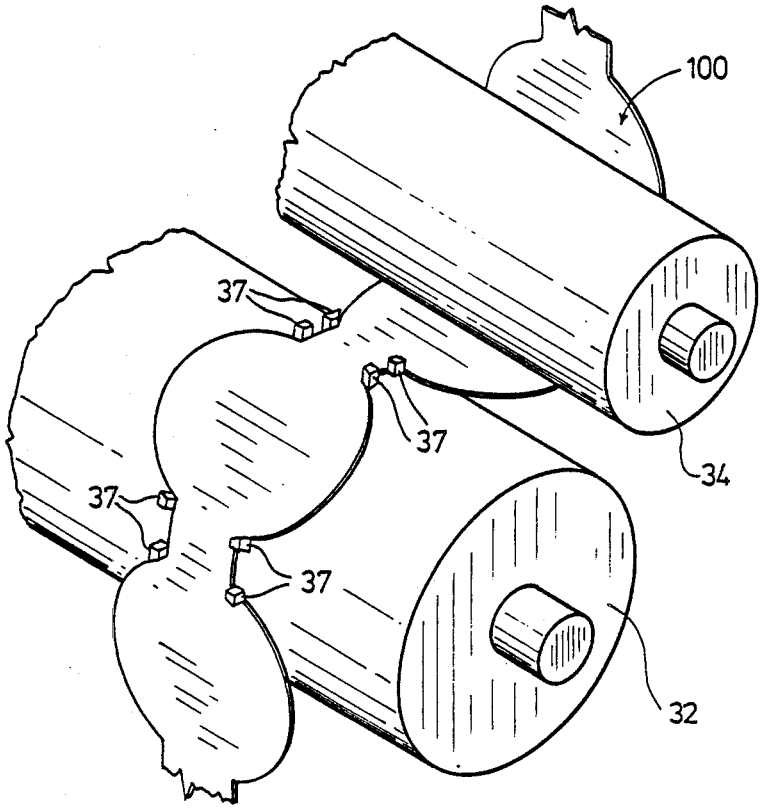
FIG. 6 is a perspective of the lid advance mechanism.

The present system achieves the result of precisely locating the lid above a container flange by allowing for a small degree of tolerance variations due to the tapered alignment lugs 124 and 122 as well as the curved portion 100 of the series of interconnected lids which is achieved through the operation of the drive drum 32. This drive drum is shown in more detail in FIG. 6 and is provided with projecting lugs 37 for engaging the series of interconnected lids. Because the drive drum 32 is constantly driven and the conveyor is intermittently advanced, the curved portion 100 is always varying to a certain extent. However, the arrangement is such that the series of lids may be positioned on drum 32 such that free end portion of the lids always curve downward to the conveyor bed in a manner such that they readily engage and move with advancement of the conveyor bed. Thus drum 32 isolates the free end portion of the series of lids from velocity and tension fluctuations between drum 32 and the supply roll 36. It is preferred to have the drum 32 constantly driven to avoid problems such as tearing of the lids between the drum and the supply roll 36 which may occur should the drum be indexed with movement of the conveyor bed.

Figure 7:
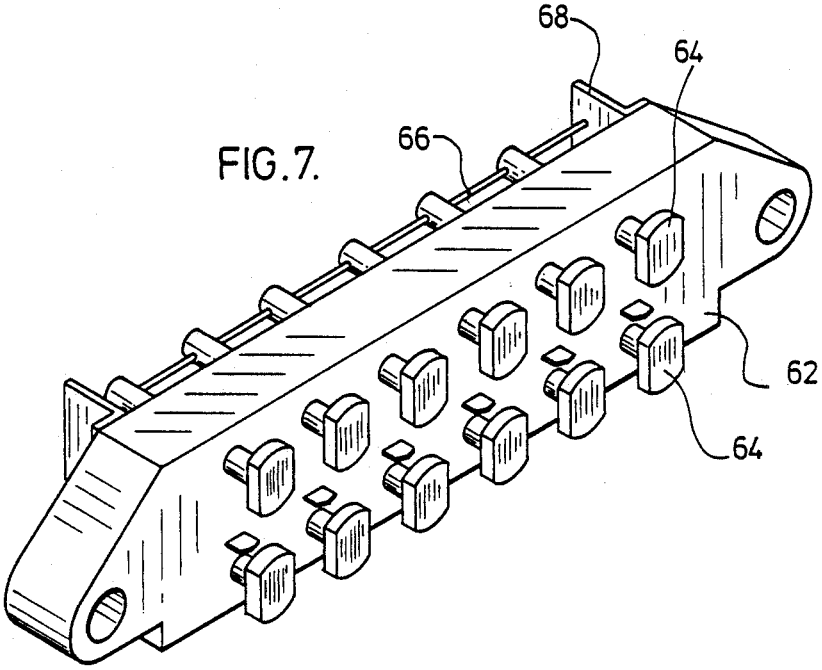
FIG. 7 is a perspective view of the clamping pads.

As can be seen in FIG. 7 the clamping pads 64 are not circular so they do not contact the guide rails 17 during the clamping operation.

Figure 8:
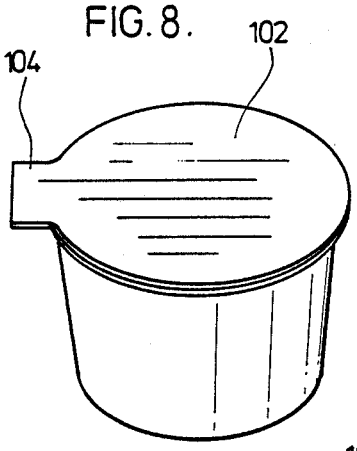
FIG. 8 is a perspective view of a container with a sealed lid.
Figure 9:
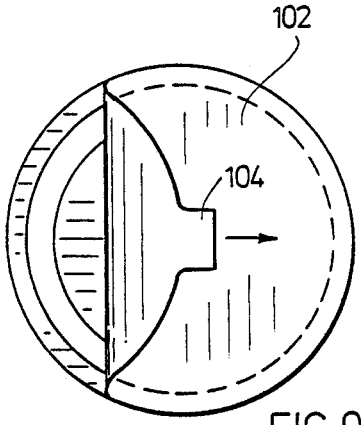
FIG. 9 is a top view with a lid partially removed from a container.
Figure 10:
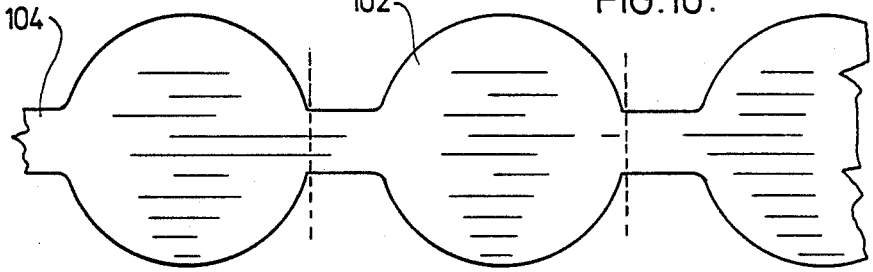
FIG. 10 shows a portion of a series of interconnected lids and the points of severance for separating the lids.

FIGS. 8 and 9 shows containers heat sealed by this process and the body portion 102 of the lid is located within the periphery of the flange. The tab portion 104 of the lid projects from the lid and assists in removal of the lid by the end user. By cutting the lids along the severance lines 105, shown in FIG. 10 the overall appearance of the finished product is enhanced as only one tab portion is provided and is preferred according to the invention.

The present invention utilizes precut, preprinted interconnected lids in combination with containers mass produced by thermoforming techniques while still providing a system in which the lid essentially corresponds to the periphery of the flange of the containers and is heat sealed thereto. Such a system results in cost savings due to the reduced size of container lids and provides a product that is less vulnerable to lid damage. Thus the final product does not appear tattered when served for consumption and the consumer is not as likely to immediately question the quality of the product.

Prior art systems have provided wide tolerance allowances in both the apparatus for handling this type of packaging operation as well as in the individual components but result in a somewhat shabby looking finished product. The present system is capable of high production output as well as obtaining the desirable characteristics of a more finished final product.

Although various embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. In a process for sealing a container with the first lid of a series of like lids interconnected by severable tabs where each lid has a body portion of essentially the same size as the container flange peripheral edge and a tab projecting from the body for removing the lid comprising in sequence the steps of:

(a) dispensing a container into a conveyor provided with an upwardly opening guide means for first loosely receiving the flange edge of a container and subsequently by said guide means contacting the flange edge precisely locating the flange edge in the conveyor;

(b) positioning said lid loosely within the guide means of the conveyor;

(c) urging said lid downwardly within the guide means, and (d) cutting said lid from the series of interconnected lids thereby allowing said lid to be precisely located at the base of the guide means above the flange of a container by virtue of the peripheral edge of said lid contacting said guide means whereby said flange edge and said lid edge are essentially aligned, said lid remaining in position above said container flange in preparation for sealing due to the continuing contact of said guide means with said lid edge.

2. The process of claim 1 wherein said lid is initially positioned loosely within the guide means synchronously advancing the series of interconnected lids with the movement of the conveyor since the free end of the series of interconnected lids is isolated from velocity and tension fluctuations of the lid supply by means for withdrawing said series of interconnected lids from the lid supply.

3. The process of claim 2 for sealing a thermoformed plastic container with said lid removed from a thermoreactive series of like lids interconnected by severable tabs, subsequent to aligning said lid edge with said flange edge in preparation for heat sealing said aligned lid to said container flange.

4. The process of claim 1 further including the step of clamping the first two lids of the series of interconnected lids to cut the interconnecting tab thereby freeing said first lid.

5. The process of claim 4 for sealing a thermoformed plastic container with said lid removed from a thermoreactive series of like lids interconnected by severable tabs, subsequent to aligning said lid edge with said flange edge in preparation for heat sealing said aligned lid to said container flange.

6. The process of claim 1 wherein said flange edge of the container is contacted by guide means at a number of positions about the periphery of said flange edge thereby eliminating lateral movement of the flange within the guide means when the flange is located at the base of the guide means.

7. The process of claim 1 wherein the lid is moved downardly by contacting the lid on the top surface and progressively moving the lid downwardly within the guide means with the movement of the conveyor.

8. The process of claim 1 wherein the guide means of the conveyor is non-continuous and only engages a portion of the periphery of said flange edge of a container and a portion of the periphery of said lid edge.

9. The process of claim 1 for sealing a thermoformed plastic container with said lid removed from a thermoreactive series of like lids interconnected by severable tabs, subsequent to aligning said lid edge with said flange edge in preparation for heat sealing said aligned lid to said container flange.

* * * * *